US006108854A

United States Patent [19]

Dingert

[11] Patent Number: 6,108,854

[45] Date of Patent: Aug. 29, 2000

[54] RUBBER BROOM

[75] Inventor: Uwe Dingert, Abtsteinach, Germany

[73] Assignee: Firma Carl Freudenberg, Weinheim, Germany

[21] Appl. No.: 09/218,744

[22] Filed: Dec. 22, 1998

[30] Foreign Application Priority Data

Dec. 22, 1997 [DE] Germany ..... 197 57 267

[51] Int. Cl.[7] ..... A46B 3/04

[52] U.S. Cl. ..... 15/188; 15/159.1

[58] Field of Search ..... 15/159.1, 171, 15/186, 187, 188

[56] References Cited

U.S. PATENT DOCUMENTS

| | | | |
|---|---|---|---|
| 848,973 | 4/1907 | Crittenden | 15/188 |
| 2,054,233 | 9/1936 | Young | 15/188 |
| 4,007,510 | 2/1977 | Scoggin et al. . | |
| 5,072,479 | 12/1991 | Van Niekerk . | |
| 5,678,899 | 10/1997 | Lewis . | |
| 5,966,771 | 10/1999 | Stroud | 15/188 |

FOREIGN PATENT DOCUMENTS

| | | | |
|---|---|---|---|
| 0 405 819 | 1/1991 | European Pat. Off. . | |
| 1085091 | 7/1954 | France | 15/187 |
| 1248028 | 10/1960 | France | 15/187 |
| 13531 | 9/1955 | Germany | 15/187 |
| 629 632 | 3/1947 | United Kingdom . | |
| 869929 | 6/1961 | United Kingdom | 15/187 |

*Primary Examiner*—Terrence R. Till
*Attorney, Agent, or Firm*—Kenyon & Kenyon

[57] ABSTRACT

A rubber broom having a broom body with a set of bristles arranged on its underside, the set of bristles being integrally formed in one piece and made of an elastic polymer material. The broom body is a molded part produced separately from the set of bristles and has an underside which is raised in the direction of the rim at at least one area. The set of bristles is a component of a deformable supporting layer that provides close-fitting contact against the underside of the broom body along at least the circumferential rim of the broom body.

9 Claims, 3 Drawing Sheets

RUBBER BROOM

BACKGROUND OF THE INVENTION

The present invention relates to a rubber broom having a broom body with a set of bristles arranged on its underside, the set of bristles being integrally formed in one piece and made of an elastic polymer material.

A rubber broom of this kind is described in European Patent B 0 405 819 and its counterpart U.S. Pat. No. 5,072,479 (the contents of which are incorporated herein by reference). The broom body and set of bristles in that case constitute a single molded part produced by the injection molding process. The molding tool used in production is configured in such a way that bristles protruding in the lateral direction extend beyond the rim of the broom body. This makes it possible, using such a rubber broom, to remove dust and dirt even from the area of corners made by a floor surface and a wall bounding the floor surface. However, the necessary molding tool is extremely difficult to manufacture and the unmolding of the produced injection-molded parts presents problems. For example, bristles frequently tear off in the process, rendering a rubber broom unsalable.

SUMMARY OF THE INVENTION

It is an object of the present invention to further develop a rubber broom of the aforementioned general type such that while being simpler and more reliable to produce, it permits the corners of spaces to be cleaned with the same ease as the known configuration.

In the rubber broom according to the present invention, the broom body is a molded part produced separately from the set of bristles, and has an underside which is raised in the direction of its rim along at least one are. The set of bristles is a component of a deformable supporting layer, and the supporting layer is in close-fitting contact with the underside, at least along the surrounding rim. The invention takes advantage of the fact that the supporting layer is integral with the set of bristles, and may be further deformed after its molding and setting. It is thus possible for the supporting layer to be configured, in compliance with the requirements of the manufacturing process, as an essentially flat structure with bristles arranged on and substantially perpendicular to it, and for the supporting layer to be affixed, after molding and setting, to a broom body, produced separately from it and having an underside which is raised along at least area in the direction of the rim. The bristles protruding substantially perpendicularly from the supporting layer are thus displaced laterally outward in the raised zone, making it possible for the rubber broom according to the present invention to be used satisfactorily for cleaning the corner zones where the floor perpendicularly meets the wall, without the broom body striking against the wall.

The bristles may be configured in a columnar shape, but if needed may also have a tapered cross-section in the protruding zone. In addition to circular profiles, preferably rectangular profiles are used, extending perpendicular to the direction of cleaning. A reciprocally overlapping assignment of the bristles has proved advantageous. Insofar as cylindrical configurations are used, there is the additional possibility of giving the bristles a polygonal, X-shaped or Y-shaped profile, at least in the protruding zone, thus achieving a substantially improved cleaning effect. The rearward zone may have a round profile, in order to provide good elasticity in all directions. The cleaning effect achieved during the intended use may thus be improved substantially. Scraper lips may likewise be integrated into the set of bristles, preferably in an arrangement in which every other row within the set of bristles is constituted by at least one scraper lip. Such a scraper lip may also have multiple sub-lips succeeding one another in the direction of movement, or spaced laterally apart, being of a limited length and in a staggered assignment to one another. This improves the flexibility of the scraper lip as a whole. With reference to the scraping away of dirt and/or water from uneven surfaces, and particularly from recesses, an improved squeegee effect may thus be achieved.

It has proved expedient for the rubber broom to be configured symmetrically, in such a way that the underside is raised at both ends in the direction of the rim. Such a rubber broom may be used equally well with reference to cleaning corners to the right and left, without requiring the broom body to be rotated. The underside may also be raised in the direction of the rim around its entire circumference, so as to provide bristles protruding beyond the rim zone in all directions.

With regard to the pivoting movement, approximating an arc of a circle, that is executed while a broom is being used as intended, it has proved advantageous if the underside makes the transition to the raised zone in a rounded-off manner. This arrangement avoids overstressing the bristles situated at the transition point.

The underside of the broom body may be constituted in the central area by a separately produced intermediate plate, insertable into an opening in the broom body and joining the broom body and the supporting layer together. Although the additional production of the intermediate plate entails some additional outlay, the resulting savings in materials and weight more than make up for that outlay. Moreover, the intermediate plate affords the possibility of molding the supporting layer into virtually any desired shape that protrudes convexly downwards, and attaching it immovably to the broom body without requiring the use of a secondary adhesive. For this purpose the supporting layer may be provided on its upper side with protrusions extending parallel to its longitudinal direction and having a T-shaped profile, the protrusions being inserted into downward-opening recesses having a corresponding cross-section in the intermediate plate. Furthermore, such an anchoring of the supporting layer has elastically resilient characteristics in certain regards, very largely precluding the possibility that the supporting layer may unintentionally become detached from the broom body during the intended use. Moreover, with such a configuration it is not necessary to use materials of related types in the production of the broom body and the supporting layer or bristles, so as to permit a sufficiently stable attachment between them. Hence in the production of the broom body, the intermediate plate and the supporting layer, materials may be used which are specifically adapted to the particular requirements of the individual part concerned. It has proved advantageous to use polypropylene for the production of the broom body, polyamide for the production of the intermediate plate, and a thermoplastically processable type of rubber (TPE) for the production of the supporting layer including the bristles.

The intermediate plate may have at least two retaining tongues protruding upward, which may be aligned with the corresponding openings entering the broom body in the lateral direction and which, together with these openings, are penetrated by retaining bolts. After wear of the set of bristles has taken place, this arrangement makes it particularly easy to replace the worn set of bristles with a new one.

The supporting layer may be bounded in the circumferential direction by a bead that externally encircles the lower rim of the broom body. This not only prevents damage upon striking against walls or furniture, but additionally prevents dirt from penetrating into the interstice between the supporting layer and the broom body, a great advantage from the standpoint of hygiene.

DETAILED DESCRIPTION

Figure 1:
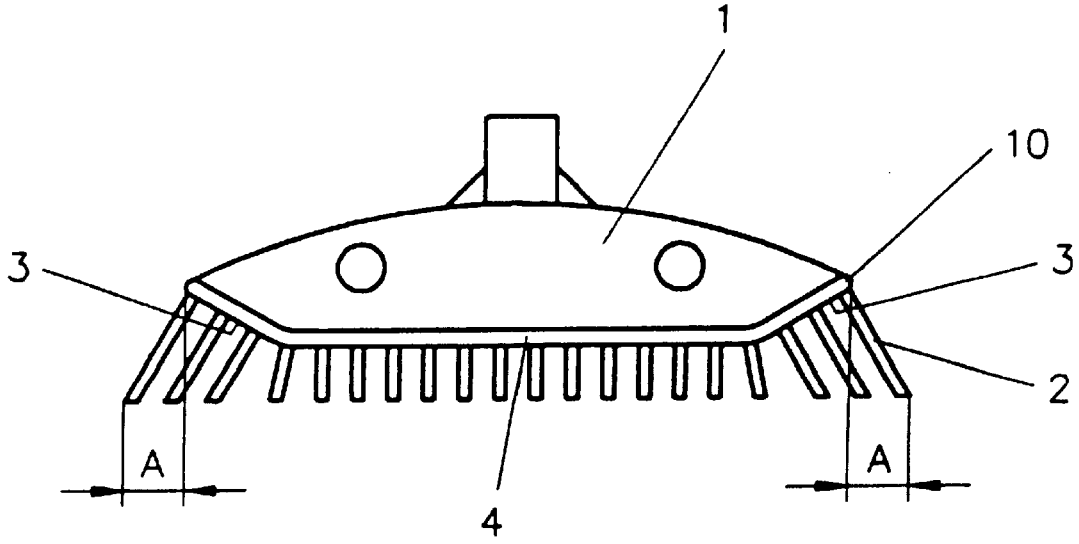
FIG. 1 is a frontal view of a rubber broom constructed according to the principles of the invention.
Figure 2:
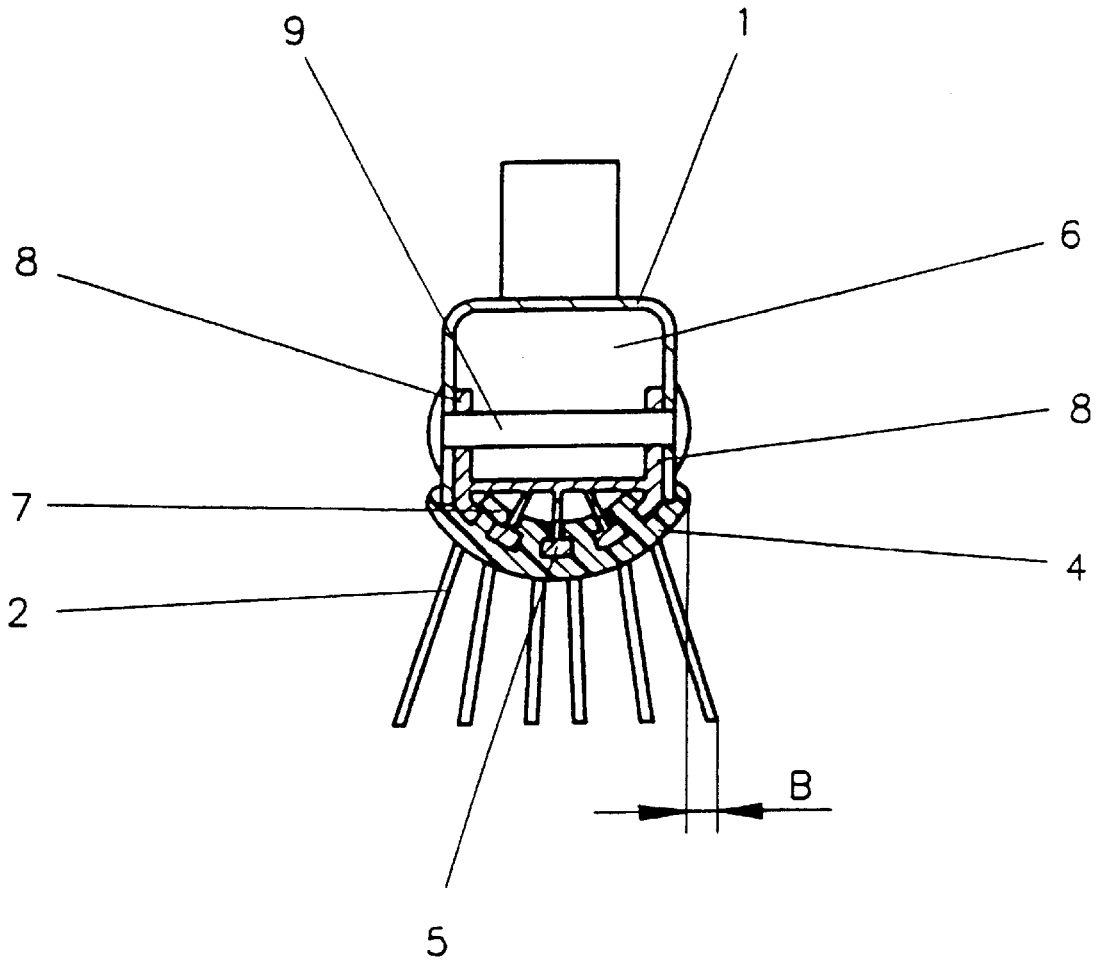
FIG. 2 is a cross-sectional view of another embodiment of a rubber broom, similar to that shown in FIG. 1, that also embodies the principles of the invention.

The rubber broom shown in FIGS. 1 and 2 has a broom body 1 with a set of bristles 2 arranged on its underside, the set of bristles being integrally formed in one piece and made of an elastic polymer material, such as TPE. Broom body 1 includes an injection-molded part made of polypropylene, configured to be hollow and produced separately from set of bristles 2. Broom body 1 has an underside which in the vicinity of area 3 is raised in the direction of both end faces, at an angle of 30° with regard to the imaginary extension of the central zone, a transition zone between the raised zone and the central zone being integrally formed in one rounded-off piece.

The set of bristles 2 is a component of a deformable supporting layer 4, which is produced in a flat shape and is deformed during its application to the underside of broom body 1 in such a way that a continuous close-fitting contact against the underside of broom body 1 results, at least along the circumferential rim. The bristles of set of bristles 2 located in the vicinity of the end faces are thus moved into a position in which they extend by the dimension A beyond the end face of broom body 1. This permits the rubber broom to be effectively used for cleaning corners where a flat floor surface meets a perpendicular wall.

The rubber broom shown in FIG. 1 is configured in such a way that supporting layer 4 having set of bristles 2 is raised only in the zone of the opposing end faces. This produces laterally protruding bristles in these two zones, while outside of these two zones the bristles do not protrude laterally. However, the invention is not restricted to this configuration, but also encompasses other configurations in which broom body 1 is surrounded in all directions by laterally protruding bristles from set of bristles 2. Such a configuration is illustrated in cross-section in FIG. 2. Supporting layer 4 shown here and having set of bristles 2 is affixed to an intermediate plate 5, which is raised around its entire circumference in the direction of the rim of broom body 1 and is configured to be convex in the central zone. The bristles of set of bristles 2 thus protrude not only in the longitudinal direction beyond the two ends of broom body 1, analogously to FIG. 1, but also on both sides by the dimension B in the lateral direction beyond the outer bounds of broom body 1. In this configuration as well, supporting layer 4 is produced in a flat shape and is subsequently converted to the shape depicted by being affixed to the intermediate plate 5. Supporting layer 4 is fastened in a form-locking manner to intermediate plate 5. For this purpose, supporting layer 4 is provided on its upper side with protrusions 7 extending parallel to its longitudinal direction and having a T-shaped profile, protrusions 7 being fitted into receptacles in intermediate plate 5 which have a corresponding cross-section and open downwards. The intermediate plate 5 is made of polypropylene. It is provided with four upward-protruding retaining tongues 8 which can be aligned with corresponding openings 6 entering broom body 1 in the lateral direction, and which, together with these openings, are penetrated by retaining bolts 9. Retaining bolts 9 are easily removable, permitting set of bristles 2 to be replaced with a new one after wear has occurred.

In FIGS. 1 and 2, the supporting layer is encircled in the circumferential direction by a bead 10 which entirely encircles the rim of the underside of broom body 1. This precludes damage from occurring when the broom impacts against furniture. Moreover, the bead prevents dirt and moisture from penetrating into the interior of broom body 1, an advantage from the standpoint of hygiene.

Figure 3:
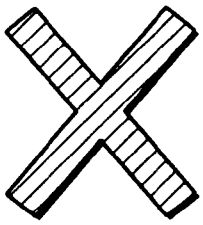
FIG. 3 is a cross-sectional view of a bristle with an X-shaped profile.
Figure 4:
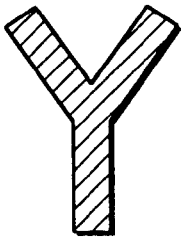
FIG. 4 is a cross-sectional view of a bristle with a Y-shaped profile.
Figure 5:
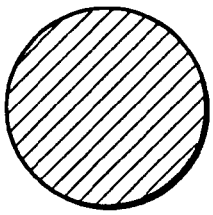
FIG. 5 is a cross-sectional view of a bristle with a circular profile.

FIGS. 3–5 show cross-sectional profiles of a bristle 2. FIG. 3 shows a bristle 2 with an x-shaped cross-section. FIG. 4 shows a bristle 2 with a Y-shaped cross-section. FIG. 5 shows a bristle 2 with a circular cross-section.

What is claimed is:

1. A rubber broom comprising:

a molded broom body having an underside that includes a portion that is elevated from the remainder of the underside, the underside also having a circumferential rim; and a deformable supporting layer configured to be attached to the underside of the broom body and separately produced therefrom, said supporting layer including a set of bristles that are integrally formed with the supporting layer and which are made of an elastic polymer material, the supporting layer being in close-fitting contact against the underside of the broom body along at least the circumferential rim, wherein the underside of the broom body has a centrally disposed, separately produced intermediate plate, insertable into an opening in the broom body and joining the broom body and the supporting layer together.

2. The rubber broom as defined by claim 1, wherein the supporting layer is provided on an upper side with protrusions extending parallel to its longitudinal direction and having a T-shaped profile, and the protrusions are inserted into downward-opening recesses having a corresponding cross-section in the intermediate plate.

3. The rubber broom as defined by claim 2, wherein the intermediate plate has at least two retaining tongues protruding upward, which may be aligned with corresponding openings entering the broom body in the lateral direction and which are configured to be penetrated, together with these openings, by retaining bolts.

4. The rubber broom as defined by claim 3, wherein supporting layer is bounded in the circumferential direction by a bead which encircles the underside of the broom body around its rim.

5. The rubber broom as defined by claim 1, wherein the supporting layer is bounded in the circumferential direction by a bead which encircles the underside of the broom body around its rim.

6. A rubber broom comprising:

a molded broom body having an underside that includes a portion that is elevated from the remainder of the underside, the underside also having a circumferential rim; and a deformable supporting layer configured to be attached to the underside of the broom body and separately produced therefrom, said supporting layer including a set of bristles that are integrally formed with the supporting layer and which are made of an elastic polymer material, the supporting layer being in close-fitting contact against the underside of the broom body along at least the circumferential rim, wherein some of the bristles protrude laterally outwardly from the broom, and at least these bristles have an X-shaped polygonal profile.

7. A rubber broom comprising:

a molded broom body having an underside that includes a portion that is elevated from the remainder of the underside, the underside also having a circumferential rim; and a deformable supporting layer configured to be attached to the underside of the broom body and separately produced therefrom, said supporting layer including a set of bristles that are integrally formed with the supporting layer and which are made of an elastic polymer material, the supporting layer being in close-fitting contact against the underside of the broom body along at least the circumferential rim, wherein some of the bristles protrude laterally outwardly from the broom, and at least these bristles have a Y-shaped polygonal profile.

8. A rubber broom comprising:

a molded broom body having an underside that includes a portion that is elevated from the remainder of the underside, the underside also having a circumferential rim; and a deformable supporting layer configured to be attached to the underside of the broom body and separately produced therefrom, said supporting layer including a set of bristles that are integrally formed with the supporting layer and which are made of an elastic polymer material, the supporting layer being in close-fitting contact against the underside of the broom body along at least the circumferential rim, wherein some of the bristles do not protrude laterally, and at least these bristles are circular in cross section, and wherein some of the bristles protrude laterally outwardly from the broom, and at least these bristles have an polygonal profile.

9. A rubber broom comprising:

a machined broom body having a peripheral rim and a lower side which is raised at at least one location;

a set of bristles arranged on the lower side of the broom body, the bristles being made of an elastic polymer material and forming one piece, the bristles being manufactured as a separate piece from the broom body, wherein, the peripheral rim of the broom body is covered by bristles protruding out in the lateral direction, and the bristle ends lie in one plane, and wherein the bristle assembly forms a part of a deformable base and the base touches the lower side at least along the peripheral rim of the broom body.

* * * * *